US005249507A

United States Patent [19]

Kawahara et al.

[11] Patent Number: 5,249,507

[45] Date of Patent: Oct. 5, 1993

[54] SWASH-PLATE PLUNGER TYPE HYDRAULIC APPARATUS

[75] Inventors: Eiichiro Kawahara, Tokorozawa; Takashi Nakamura, Utsunomiya, both of Japan

[73] Assignee: Honda Giken Kogyo Kabushiki Kaisha, Tokyo, Japan

[21] Appl. No.: 827,069

[22] Filed: Jan. 28, 1992

[30] Foreign Application Priority Data

Jan. 28, 1991 [JP] Japan ..... 3-026938

[51] Int. Cl.[5] ..... F01B 13/04

[52] U.S. Cl. ..... 92/57; 92/71; 74/60

[58] Field of Search ..... 92/12.2, 57, 71; 91/499; 417/269; 74/60

[56] References Cited

U.S. PATENT DOCUMENTS 3,453,965 7/1969 Heinrich ..... 91/499

FOREIGN PATENT DOCUMENTS 2616985 11/1976 Fed. Rep. of Germany ..... 91/499
5770968 10/1980 Japan .
0939818 6/1982 U.S.S.R. ..... 74/60
1423779 9/1988 U.S.S.R. ..... 92/157
1435805 11/1988 U.S.S.R. ..... 92/71

OTHER PUBLICATIONS

English language translation of Abstract of JP 57-70968.

*Primary Examiner*—Thomas E. Denion
*Attorney, Agent, or Firm*—Lyon & Lyon

[57] ABSTRACT

A plunger and swash-plate type hydraulic pump or motor with a retainer plate 30 that presses a slidable abutment 22 of each of a plurality of shoe members 20 against a slidably abutting surface 8*a* of a swash-plate 8 in such a manner that a neck 21 of each shoe member is inserted into each of a plurality of insertion holes 31 of the retainer plate 30. An imaginary center plane $C_3$ or $C_4$ of the part of the inner surface of each of the insertion holes 31 which abuts against the outer periphery 21*a* of the neck 21 is coincident with the center $O_1$ around which each of the shoe members 20 swings relatively to the plunger 10 in the axial direction of each of the insertion holes 31.

3 Claims, 6 Drawing Sheets

FIG. 1
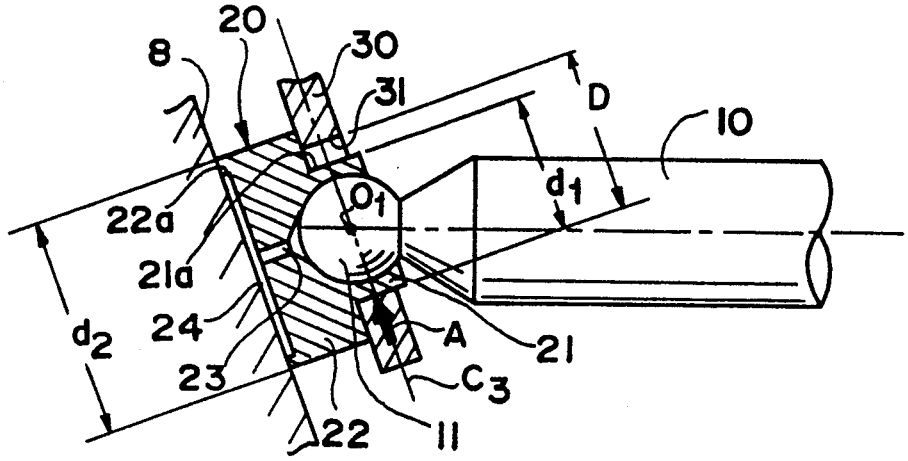
FIG. 2
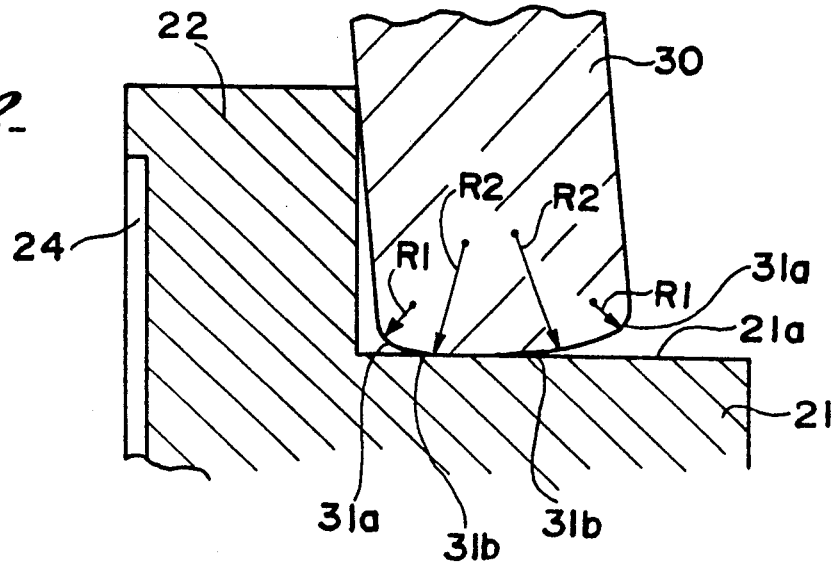
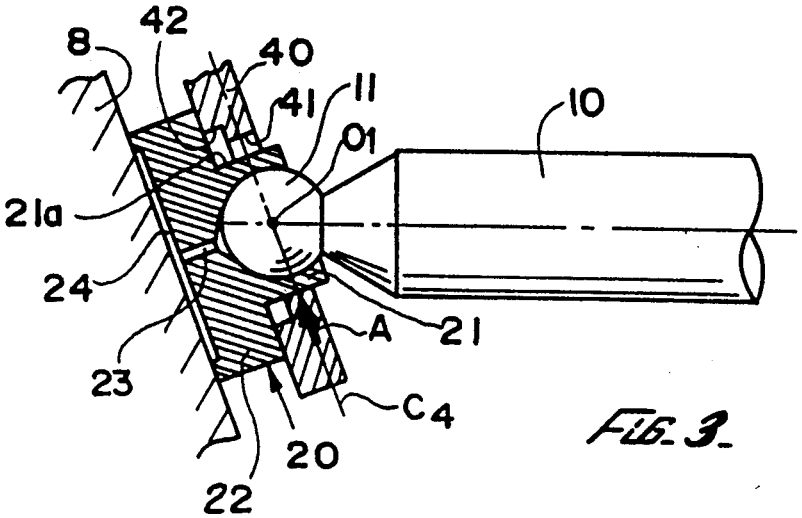
FIG. 3

SWASH-PLATE PLUNGER TYPE HYDRAULIC APPARATUS

BACKGROUND OF THE INVENTION

1. Field of the Invention

The present invention relates to a hydraulic apparatus such as a swash-plate plunger type hydraulic pump or motor.

2. Description of the Related Arts

In such a swash-plate plunger type hydraulic apparatus, one end of each of a plurality of plungers is slidably fitted into a cylinder block in such an arrangement as to annularly surround a rotational shaft thereof and the other ends of the plungers are brought into sliding contact with a swash-plate for rotation along with the cylinder block, to thereby reciprocate the plungers. In this way, the ends of the plungers are moved along the swash-plate while being in sliding contact therewith, and hence there is often employed a structure where shoe members are swingably mounted on the ends of the plungers so that the shoe members can be in sliding contact with the swash-plate (for example, refer to Japanese Unexamined Patent Publication (Kokai) No. 57-70968). In this case, it is also well-known to use a retainer plate for pressing the shoe members against the swashplate since the shoe members are liable to be separated from the swash-plate when they are moved along the swash-plate at a high-speed in accordance with the rotation of the cylinder block.

FIG. 4 shows an example of such swash-plate plunger type hydraulic apparatus. The basic arrangement of both the conventional apparatus and the apparatus according to the present invention are shown in FIG. 4, which merely differ in the construction of the shoes 2, 20 and the retainer plate 3, 30. Reference numerals 2 and 3 denote the shoes and the retainer plate of the conventional apparatus, respectively, while reference numerals 20 and 30 designate the shoes and the retainer plate according to the present invention, respectively.

A spherical part 11 is provided at one end of each of plungers 10 which are slidably fitted into cylinder holes annularly arranged in the cylinder block 1 so as to surround a rotational axis $C_1$, and each of the shoes 2 is swingably linked with the spherical part 11. These shoes 2 are in sliding contact with a slidably abutting surface 8*a* of the swash-plate member 8, and move along the surface 8*a* in accordance with the rotation of the cylinder block 1, to thereby reciprocate the plungers 10 within the cylinder holes 1*a*. During rotation, the retainer plate 3 presses the shoes 2 against the slidably abutting surface 8*a* so as to prevent the shoes from separating from the slidably abutting surface 8*a*. The retainer plate 3 is held in position through bearings 4 by means of a hold-down plate 5 secured to the swash-plate 8 with bolts.

As is apparent from FIG. 6 showing the prior art arrangement, this retainer plate 3 has a plurality of insertion holes provided corresponding to the shoes 2, and presses the slidable abutment 2*b* against the swash-plate 8 while inserting the necks 2*a* of the shoes 2 into the associated insertion holes 3*a*.

For this reason, the retainer plate 3 is caused to rotate along the inclined slidably abutting surface 8*a* of the swash-plate 8 together with the shoes 2. In this case, the plungers 10 to be linked with the shoes 2 rotate around the rotational shaft $C_1$ cooperatively with the cylinder block 1 in a circulate orbit, whereby the shoes 2 each ovally move along the swash-plate. FIG. 5 shows the oval movement of each of the shoes 2. Since the retainer plate 3 is rotated along the swash-plate 8 while permitting the oval movement of each of the shoes 2, insertion holes 3*a* of the retainer plate 3 have the inner diameter D larger than the outer diameter d of the neck 2*a* of each of the shoes 2. FIG. 5 shows a positional relationship between the neck 2*a* and the associated insertion hole 3*a* every 90° of rotation when the shoes rotate half along the swash-plate 8, and hence the inner diameter D of the insertion holes 3*a* is so made as to be larger than the outer diameter d of the neck 2*a* of each of the shoes 2 by a dimension to permit the oval movement of the shoes 2.

As a result, during the rotation of the cylinder block 1, the shoes 2 are allowed to slidably move along the swash-plate 8 while the outer periphery of the neck 2*a* of each of the shoes 2 comes in contact with the inner periphery of each of the insertion holes 3*a* of the retainer plate 3, which causes the shoes 2 to press against the retainer plate 3 for causing the rotation thereof.

On thus rotated retainer plate 3, there is exerted a reaction force (resistance) in the direction opposite to that of the rotation thereof, which acts on the shoes 2. Moreover, the position where the shoes are subjected to the reaction force varies depending on the movement of the shoes 2.

Furthermore, as shown in FIGS. 7 to 15, the shoe 2 that is subjected to the reaction force derived from the retainer plate 3 among the plurality of shoes 2 are intermittently changed according to the rotational angle of the cylinder block 1. FIGS. 7 to 15 show the relationship of the abutment between the neck 2*a* of each of shoes 2 and the associated insertion hole 3*a* of the retainer plate 3 for every 8° of rotational angle when the cylinder block 1 having five plungers 10 is rotated. In FIGS. 7–15, the right-hand side corresponds to the side of the top dead center (T.D.C.) while the left-hand side corresponds to the side of the bottom dead center (B.D.C), and the relationship between the shoes 2 and the retainer plate 3 is shown in the case where the cylinder.block 1 is rotated by 8° in the clockwise direction in each Figure from the state shown in FIG. 7 to the state shown in FIG. 15. Also, the reference point of the arrow A shown in the drawings designates the position where the neck 2*a* is in contact with the insertion hole 3*a* (the position subjected to the reaction force), and the direction of the arrow A signifies the direction of the reaction force. As clearly seen from these drawings, the shoe 2 to be subjected to the reaction force is intermittently changed in accordance with the rotation of the cylinder block.

FIG. 6 illustrates one of the shoes 2 which is subjected to the reaction force shown with the above-mentioned arrow A by way of example. As is clear from this figure, the reaction force acts on the imaginary center plane $C_2$ in the axial direction of each of the insertion holes 3*a* of the retainer plate 3 (the imaginary center plane in the thickness direction of the retainer plate 3). In this case, the imaginary center plane $C_2$ of the retainer plate 3 to be subjected to the reaction force A is spaced from the center $O_1$ around which each of shoes 2 swings, and accordingly each of the shoes 2 is adversely subjected to a moment in the direction where it is caused to rotate or swing around the center $O_1$ due to the reaction force A. For this reason, there arises a problem that the shoes 2 are tilted as shown by the dotted line in the FIG. 6, which causes the bottom surface 2c thereof to be separated from the slidably abutting surface 8a of the swash-plate 8, thereby obstructing the stable sliding movement of the shoes 2. In particular, the reaction force A is intermittently exerted on each of the shoes 2 as shown in FIGS. 7 to 15, which may bring about the inclination of the shoes 2.

Further, the conventional structure is such that a groove 2d serving as a hydrostatic bearing is provided at the bottom surface of each of the shoes 2, into which the oil pressure within the cylinder holes 1a is supplied through an oil passage (not shown) passing through each of the plungers 10 and a further oil passage 2e provided in each of the shoe 2. In such structure, there also arises a problem that the function of the hydrostatic bearing may be deteriorated due to the leakage of the oil out of the groove 2d if each of the shoes 2 is tilted as described above.

Moreover, the inclination of the shoes 2 may cause the neck 2a to roughly abut against the corners of each of the insertion holes 3a in the retainer plate 3, thus leading to the wear or scuffing of the associated part.

SUMMARY OF THE INVENTION

It is an object of the present invention to prevent the shoe members swingably attached to ends of the plungers from separating from the slidably abutting surface of the swash-plate during rotation in the swash-plate plunger type hydraulic apparatus.

It is another object of the present invention to prevent the shoe members from tilting due to the reaction force exerted on the shoe members from the retainer plate during the rotation, thus preventing the separation of the shoe members from the slidably abutting surface of the swash-plate.

It is further object of the present invention to prevent the wear or scuffing caused by the abutment of the neck of each of the shoe members with the corners of the retainer plate even though the shoe members are tilted.

In order to achieve the above objects, the apparatus of the present invention has a structure where the retainer plate presses the slidable abutment of each of the shoe members against the surface of the swash-plate while the neck of each of the shoe members is inserted into one of the insertion holes provided on the retainer plate, and at that time the imaginary center plane in the axial direction of the part where the outer periphery of the neck is brought into contact with the inner surface of the each of insertion holes is coincident with the center around which each of the shoe members swings relatively to the plungers in the axial direction of each of the insertion holes.

It is a further desirable aspect of this invention to form rounded portions having a predetermined diameter at the corners of the insertion holes of the retainer plate, and a further rounded portion continuous with the rounded parts having the predetermined radius and having a radius larger than the predetermined radius in the inner surface of each of the insertion holes.

In the swash-plate plunger type hydraulic apparatus thus configured, the imaginary center plate in the axial direction of the part in which the outer periphery of the neck abuts against the inner surface of each of the insertion holes of the retainer plate is coincident with the center around which each of the shoes swings relatively to the plungers. Therefore, the reaction force which is exerted on the shoe members from the retainer plate is directed toward the center around which each of the shoes swings, whereby a moment in the swinging direction is not generated in the shoe members even though the reaction force is exerted.

The formation of the rounded portions at the corners and the inner surfaces of the insertion holes functions to suppress the scuffing and wear of the associated part since the rounded parts are brought into contact with the outer periphery of each of the shoe members even though the shoe members are tilted.

The above and other objects, features, and advantages of the present invention will become apparent from the following description when taken in conjunction with the accompanying drawings which illustrate a preferred embodiment of the present invention by way of example.

BRIEF DESCRIPTION OF THE DRAWINGS

FIG. 1 is a sectional view on an enlarged scale of shoes and a retainer plate and the vicinity thereof in the swash-plate plunger type hydraulic apparatus according to the present invention;

FIG. 2 is a sectional view on a further enlarged scale of the shoes and the retainer plate;

FIG. 3 is a sectional view on an enlarged scale of shoes and a retainer plate in the swash-plate plunger type hydraulic apparatus according to another embodiment of the present invention;

DESCRIPTION OF THE PREFERRED EMBODIMENTS

Figure 4:
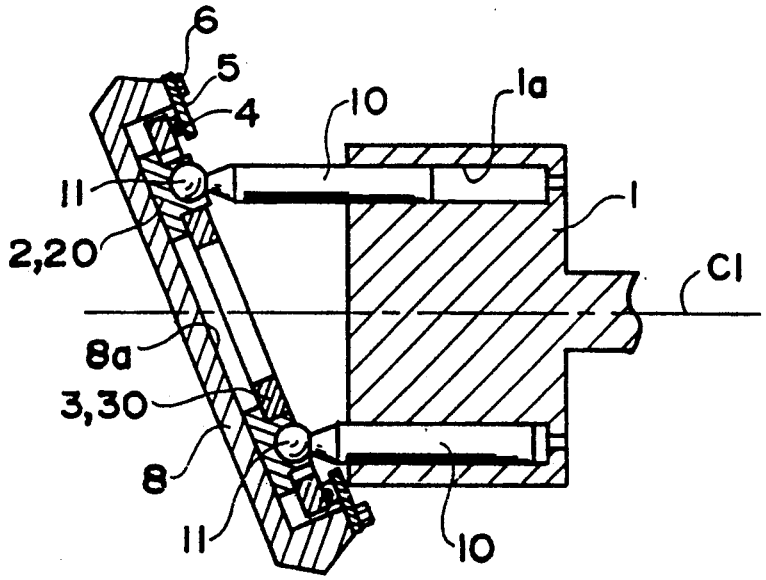
FIG. 4 is a sectional view showing the swash-plate plunger type hydraulic apparatus.
Figure 6:
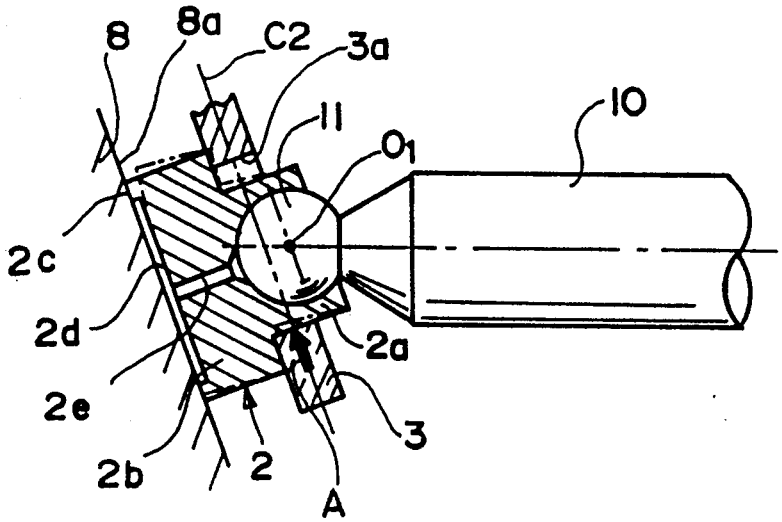
FIG. 6. (PRIOR ART)
FIG. 6 is a sectional view on an enlarged scale of the shoe and the retainer plate in a conventional prior art swash-plate plunger type hydraulic apparatus.

As described above, the pump shown in FIG. 4 is also a swash-plate plunger type hydraulic pump embodying the present invention. As shown in FIG. 4, this hydraulic pump includes a cylinder block 1 which is rotatable around a rotational axis $C_1$. The cylinder block 1 has a plurality of cylinder holes 1a which are axially extending and circumferentially equally spaced thereon. The cylinder holes each slidably receive their respective plungers 10, and each of the plungers 10 has at its one end a spherical part 11, to which a shoe 20 is swingably attached. These shoes 20 are in contact with a slidably abutting surface 8a of a swash-plate 8 and move along the swash-plate 8 in accordance with the rotation of the cylinder block 1, while the plungers 10 reciprocate within the cylinder holes la. A retainer plate 30 presses the shoes 20 against the slidably abutting surface 8a in order to prevent the shoes 2 from separating from the slidably abutting surface 8a. The retainer plate 30 is held through bearings 4 by means of a hold-down plate 5 secured to the swash-plate 8 by bolts 6.

The structure described above is substantially the same as that of a conventional hydraulic pump. The hydraulic pump of this embodiment has, however, shoes 20 and a retainer plate 30 that are different in structure from the conventional ones and are shown on an enlarged scale in FIG. 1.

Figure 5:
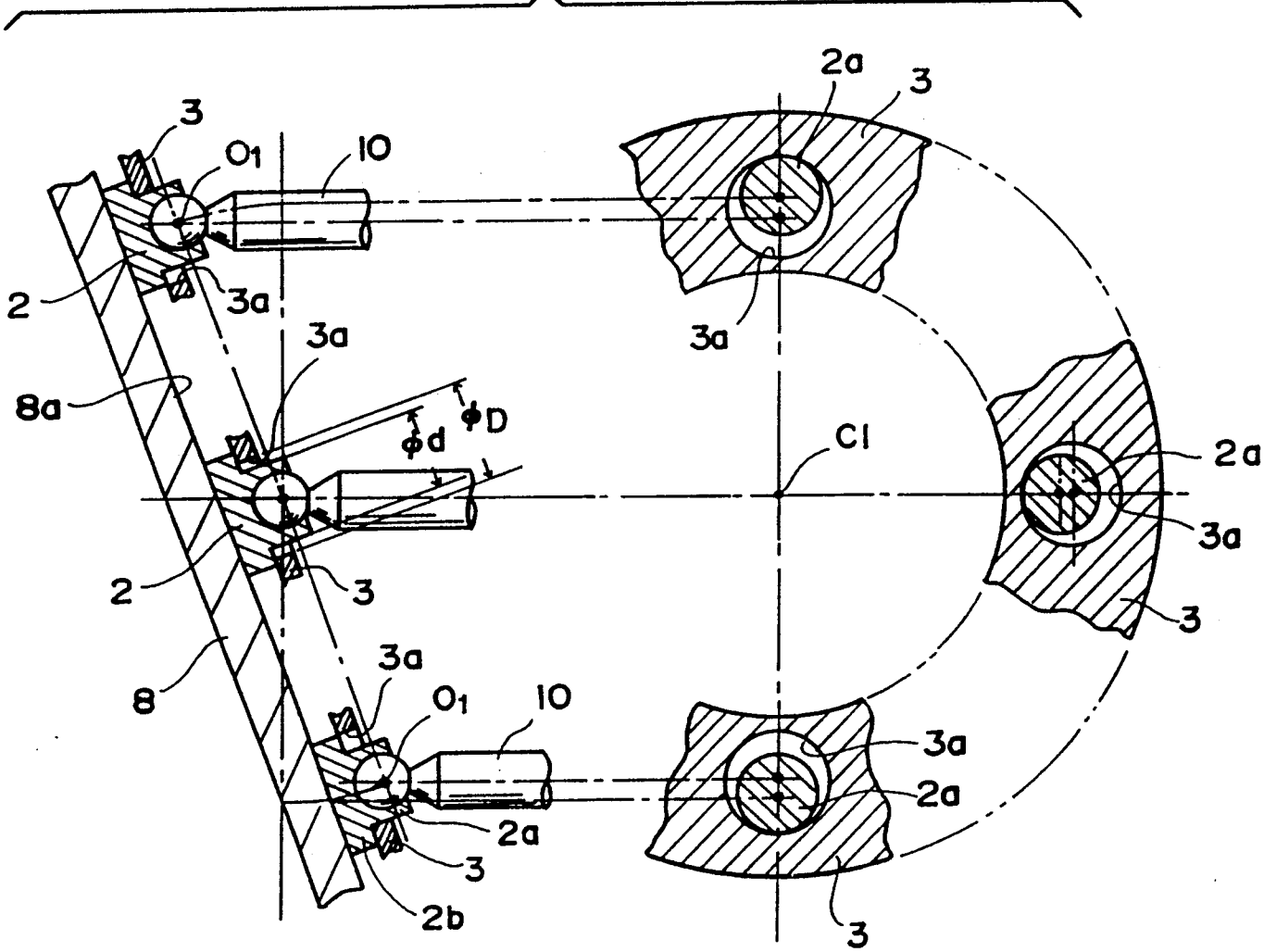
FIG. 5 is a sectional view showing the movement of the shoes along the swash-plate in the swash-plate plunger type hydraulic apparatus.
Figure 9:
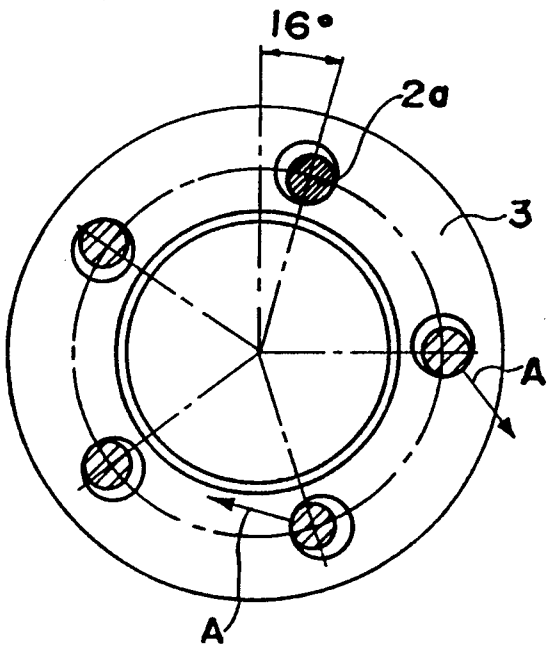
FIGS. 7 to 15 are sectional views each showing the progressive positional relationship of the retainer plate for retaining the shoes relative to the movement of the shoes.
Figure 8:
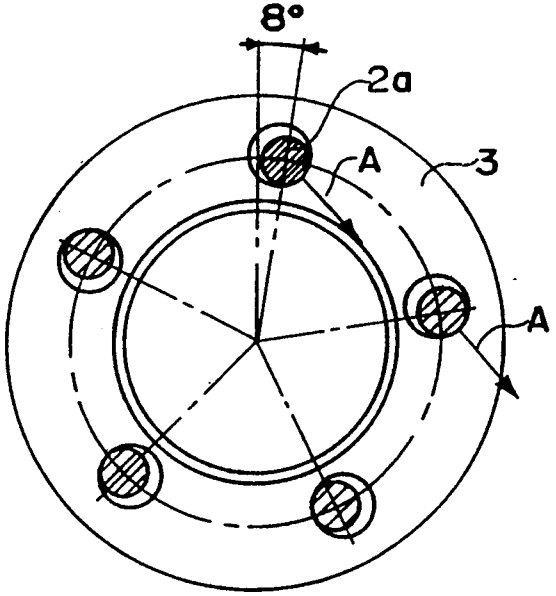
Figure 7:
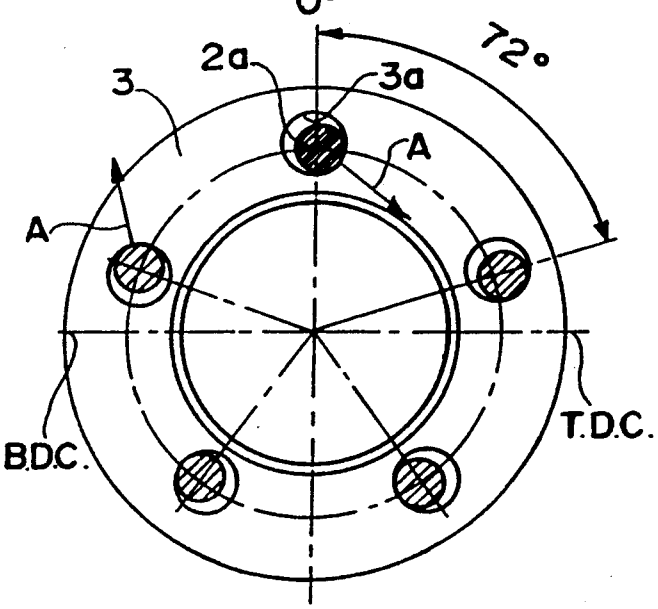
Figure 12:
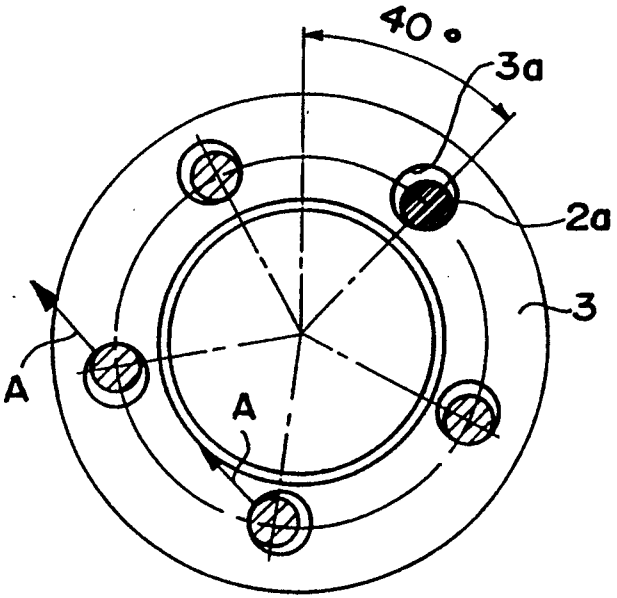
Figure 11:
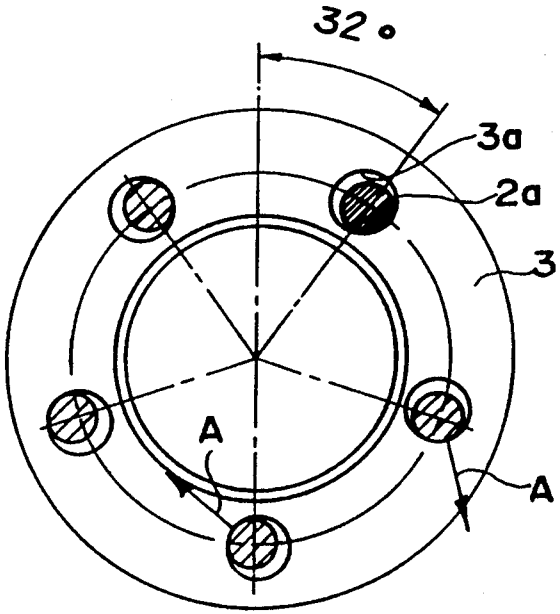
Figure 10:
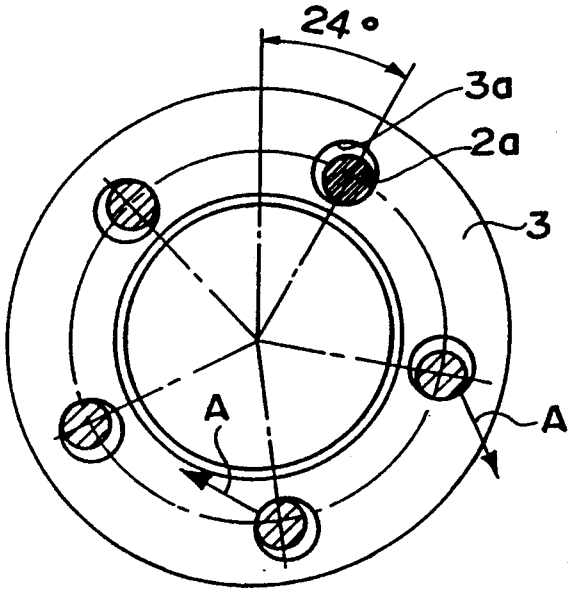
Figure 15:
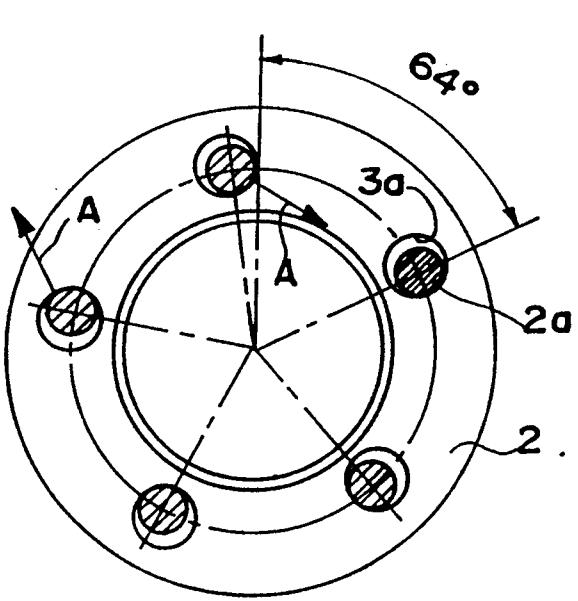
Figure 14:
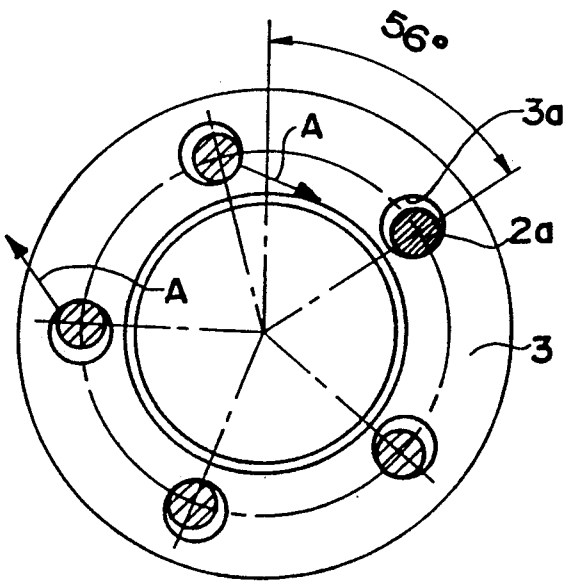
Figure 13:
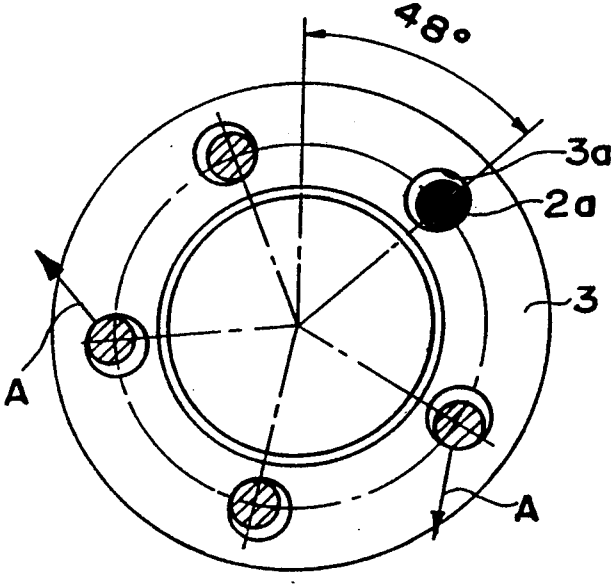

The shoes 20 are each formed integrally by a neck 21, which is swingably linked with the spherical part 11 located at one end of the plunger 10, and a slidable abutment 22 having a bottom surface 22*a* which is in sliding contact with the slidably abutting surface 8*a* of the swash-plate 8. The neck 21 has an outer peripheral diameter d smaller than the outer peripheral diameter $d_2$ of the slidable abutment 22. The retainer plate 30 includes a plurality of insertion holes 31 corresponding to the associated shoes 20, into which the necks 21 are inserted to mount the retainer plate 30 which presses the slidable abutment 22 against the swash-plate 8. The inner diameter D of each of these insertion holes 31 is larger than the outer diameter $d_1$ of the neck 21 so as to allow the shoes 20 to ovally move along the slidably abutting surface 8*a* of the swash-plate 8 as shown in FIG. 5.

The swash-plate 8 is swingable from the upstanding state (the state in which the slidably abutting surface 8*a* is orthogonal to the rotational axis $C_1$) to the maximum angle of inclination, and the inner diameter D of the insertion holes 31 is so designed that the shoes 20 are allowed to ovally move even though the swash-plate 8 is tilted up to the maximum angle of inclination.

Each of the shoes 20 has a groove formed on the bottom surface 22*a* of the slidable abutment 22 thereof, which serves as a hydrostatic bearing so that the oil pressure within a cylinder bore la into which the plunger 10 is slidably fitted is supplied into the groove 24, through an oil passage (not shown) which passes through the plunger 10, and an oil passage 23 provided within the shoe 20.

In the hydraulic pump thus constituted, the cylinder block 1 is rotated around the rotational axis $C_1$ to slidably move the shoes 20 along the slidably abutting surface 8*a* of the swash-plate 8, thereby reciprocating the plungers 10 within the cylinder bores 1*a* for the pumping. At that time, the outer periphery 21*a* of the neck 21 of each of the shoes 20 is brought into contact with the associated inner surface 31*a* of each of the insertion holes 31 of the retainer plate 30, which causes the retainer plate 30 to rotate simultaneously. In this case, a reaction force A exerted on each of the shoes 20 by the retainer plate 30 is directed along the center plane $C_3$ in the axial direction of each of the insertion holes 31 (thickness direction of the retainer plate 30) as shown in FIG. 1.

In this embodiment each of the shoes 20 and the retainer plate 30 are formed in such a manner that the center plate $C_3$ is coincident with the center $O_1$ around which each of the shoes 20 swings (the center of the spherical part 11). For this reason, the reaction force A is exerted toward the center $O_1$ around which each of the shoes 20 swings, and does not bring about a force moment around the center $O_1$.

Consequently, in the hydraulic pump of this embodiment, the shoes 20 are not caused to tilt even though the shoes are subjected to the reaction force A arising from the retainer plate 30 during rotation of the cylinder block 1, thereby slidably moving the shoes 20 smoothly, and maintaining the function of the hydrostatic bearing in the form of the groove 24 provided on the bottom surface 22*a* of each of the shoes 20.

A first radii (roundings) 31*a* each having a relatively small radius R are provided on the corners of the insertion holes 31 of the retainer plate 30 as shown in FIG. 2. Each of the insertion holes 31 further has on the inner surface thereof a second radius (rounding) 31*b* having a radius $R_2$ larger than the radius $R_1$, which is smoothly continuous with the first radii 31*a*. This ensures that the inner surface of each of the insertion holes 31 of the retainer plate 30 is, at substantially the center in the axial direction thereof, brought into contact with the outer periphery of the neck 21 of each of the shoes 20.

The radiused corners of each of the insertion holes 31 are not allowed to come into contact with the outer periphery 21*a* of the neck 21 even in the case where the shoes 20 are tilted as shown in FIG. 2, thus preventing the occurrence of wear on the corners, dragging or the like. Further, the second radius 31*b* having the larger radius $R_2$ comes into contact with the outer peripheral 21*a* of the neck 21 in such a tiled condition, and hence the part adjacent to the center of the inner surface of each of the insertion holes 31 in the axial direction thereof is allowed to abut against the outer periphery 21*a* of the neck 21.

There is a case where it is difficult to cause the center plane of the inner surface of each of the insertion holes in the axial direction thereof to be coincident with the center around which each of the shoes swings due to the thickness requirements for the retainer plate or the like. In such a case, as shown in FIG. 3, a groove or facing 42 may be provided at the lower portion of each of the insertion holes 41 of the retainer plate 40 to adjust the thickness whereby the outer periphery 21*a* of the neck 21 of each of the shoes abuts against the insertion holes 41 in such a manner that the center plane $C_4$ of the portion abutting against the outer periphery 21*a* coincides with the center $O_1$ around which each of the shoes 20 swings.

The above description is made in connection with a swash-plate plunger type hydraulic pump by way of example but the present invention is not confined to this embodiment, and the same structure can also be applied to the swash-plate plunger type hydraulic motor. Although a certain preferred embodiment of the present invention has been shown and described in detail, it should be understood that various changes and modifications may be made therein without departing from the scope of the appended claims.

What is claimed is:

1. A swash-plate plunger type hydraulic apparatus, comprising:

a cylinder block rotatably mounted for rotation about an axis;

a plurality of plungers slidably fitted into said cylinder block in such an arrangement as to annularly surround said rotational axis;

a swash-plate having a surface which confronts one end of each of said plungers;

a plurality of shoe members facing said swash-plate surface and swingably linked with said end of said plungers, respectively; and a retainer plate for retaining said shoe members in sliding contact with said swash-plate surface;

each of said shoe members integrally including a neck swingably lined with said one of each of said plungers and a slidable abutment in sliding contact with said swash-plate surface, and said retainer plate including a plurality of insertion holes each for receiving said neck and adapted to press said slidable abutment against said swash-plate surface with said neck of each of said shoe members inserted into one of said insertion holes, wherein each of said insertion holes has an inner surface with a portion which abuts against an outer periphery of said neck at an imaginary center platen of said portion in the axial direction of said insertion hole which is substantially coincident with a center around which each of said shoe members swings relatively to each of said plungers, and a spot facing is provided at the lower portion of each of said insertion holes to adjust the thickness across which the outer periphery of said neck abuts against each of said insertion holes in such a manner that an imaginary center plane of the portion of each of said insertion holes which is in contact with the outer periphery of said neck coincides with the center around which each of said shoe members swings.

2. A swash-plate plunger type hydraulic apparatus comprising:

a cylinder block rotatably mounted for rotation about an axis;

a plurality of plungers slidably fitted into said cylinder block in such an arrangement as to annularly surround said rotational axis;

a swash-plate having a surface which confronts one end of each of said plungers;

a plurality of shoe members facing said swash-plate surface and swingably linked with said end of said plungers, respectively; and a retainer plate for retaining said shoe members in sliding contact with said swash-plate surface;

each of said shoe members integrally including a neck swingably linked with said one end of each of said plungers, and a slidable abutment in sliding contact with said swash-plate surface, said retainer plate including a plurality of insertion holes each for receiving said neck and adapted to press said slidable abutment against said swash-plate surface with said neck of each of said shoe members inserted into one of said insertion holes, wherein each of said insertion holes has an inner surface with a portion which abuts against an outer periphery of said neck at an imaginary center plane of said portion in the axial direction of said insertion hole which is substantially coincident with the center around which each of said shoe members swings relatively to each of said plungers, and a rounded portion having a predetermined radius is provided at both corners of each of said insertion holes of said retainer plate, and a further rounded portion having a radius larger than said predetermined radius and continuous with said rounded portions having said predetermined radius is provided on the inner surface of each of said insertion holes.

3. A swash-plate plunger type hydraulic pump or motor having a rotatably mounted cylinder block, a plurality of plungers slidably fitted into said cylinder block, a swash-plate having a surface facing the cylinder block, a plurality of shoe members positioned between the swash-plate surface and the cylinder block, each shoe member having a neck swingably linked with an end of a said plunger, extending from the cylinder block and a portion in sliding contact with the swash-plate surface, a retainer plate for retaining said shoe members in sliding contact with said swashplate surface, said retainer plate including a plurality of insertion holes for receiving a said neck of each of said plungers, the improvement comprising:

each of said insertion holes having a portion that abuts the outer periphery of said neck at an imaginary center plane, in the axial direction thereof, which is substantially coincident with a center around which each of said shoe members swings relatively to each of said plungers, wherein a groove is provided at another portion of each of said insertion holes closer to the swash-plate for reducing the thickness across which the inner periphery of said insertion hole abuts against each said neck in such a manner that said imaginary center plane of the first said portion of each of said insertion holes which is in contact with the outer periphery of said neck substantially coincides with the center around which each of said shoe members swings.

* * * * *

UNITED STATES PATENT AND TRADEMARK OFFICE

CERTIFICATE OF CORRECTION

PATENT NO. : 5,249,507

DATED : October 5, 1993

INVENTOR(S) : Kawahara et al.

It is certified that error appears in the above-indentified patent and that said Letters Patent is hereby corrected as shown below:

Column 7, line 3, delete "platen" and insert -- plane --.

Signed and Sealed this

Eleventh Day of October, 1994

Bruce Lehman

*Attest:*

BRUCE LEHMAN

*Attesting Officer*

*Commissioner of Patents and Trademarks*